US005568861A

United States Patent [19]

Lamberti

[11] Patent Number: 5,568,861

[45] Date of Patent: Oct. 29, 1996

[54] ELECTRICAL SWITCH WITH A ROCKER KEY AND A SPILLWAY FOR THE EXTERNAL DISCHARGE OF WATER

[75] Inventor: Silvano Lamberti, Roncadelle, Italy

[73] Assignee: SI.BE.R.s.r.l., Brescia, Italy

[21] Appl. No.: 383,890

[22] Filed: Feb. 6, 1995

[30] Foreign Application Priority Data

Apr. 1, 1994 [IT] Italy ..... BS9400023

[51] Int. Cl.[6] ..... H01H 19/06

[52] U.S. Cl. ..... 200/302.003; 200/339; 200/302.001; 200/553

[58] Field of Search ..... 200/302.3, 339, 200/553, 554, 555, 556, 557, 558, 559, 560, 561, 562, 563, 302.1, 302.2, 341

[56] References Cited

U.S. PATENT DOCUMENTS

| | | | |
|---|---|---|---|
| 4,803,317 | 2/1989 | Sutoh et al. | 200/339 |
| 5,045,648 | 9/1991 | Fogleman, Sr. | 200/339 |
| 5,117,074 | 5/1992 | Yanai et al. | 200/302.3 |

*Primary Examiner*—David J. Walczak
*Attorney, Agent, or Firm*—Richard E. Jenkins, P.A.

[57] ABSTRACT

Electrical switch having a body that includes two perimeter walls and second internal walls that are parallel to the perimeter walls. The second inner walls in combination with the perimeter walls define a continuous channel that is adapted to collect and discharge water or condensation.

9 Claims, 1 Drawing Sheet

ELECTRICAL SWITCH WITH A ROCKER KEY AND A SPILLWAY FOR THE EXTERNAL DISCHARGE OF WATER

TECHNICAL FIELD

This utility model refers to the field of electrical switches, and more specifically involves a switch with a rocker key and means for the collection and discharge of water or condensation.

OBJECTS AND SUMMARY OF THE INVENTION

Among other applications, electrical switches of this type are widely used in equipment and electrical household appliances intended to be operated in the presence of water and/or in environments with high humidity, in which condensation can occur. To comply with safety standards, such switches must be built in such a way that they prevent the passage of water and condensation into their body, i.e., toward the internal electrical components. For this purpose, a switch has already been proposed whose body, at its front, has a double wall that defines a channel for the collection of water and condensation, with lateral apertures at the base to discharge water to the outside of the body. The rocker key is located in, and moves back and forth within, this channel, and is also affixed to the outer lateral walls of the body in such a way that it can pivot. In fact, the key has two outwardly oriented lateral pins that are inserted into open holes in the side walls of the body.

The purpose of this invention is to provide an electrical switch with a rocker key of the type described above, but in which a particular configuration of the body in the region of the front channel makes it possible to discharge any water or condensation that may have collected in the channel, achieving this discharge over the spillway formed by the outer wall of the channel. In this way the lateral discharge apertures at the bottom of the channel are eliminated. Meanwhile, to keep water from entering the inside of the switch, the inner perimeter wall of the channel is higher than the outer edge or spillway. Consequently, any water will always flow out over the outer edge before it reaches the top of the higher inner wall.

Pursuant to another characteristic of the invention, the rocker key is attached to two inner walls facing the channel, in such a way that it can pivot, with the advantage of eliminating the open apertures in the outer lateral walls of the body of the switch, thereby also eliminating the open apertures in the channel.

DETAILED DESCRIPTION OF THE INVENTION

Figure 2:
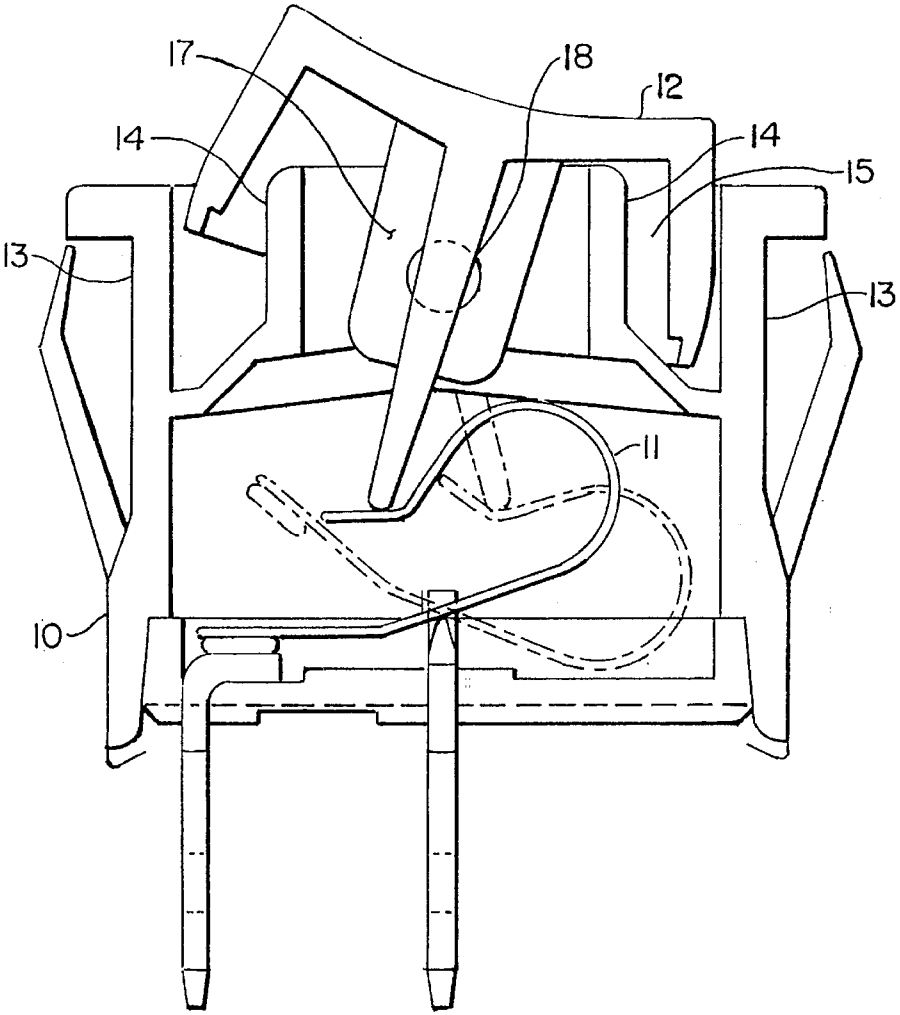
FIG. 2 is a longitudinal cross-sectional view, likewise a partial view, along the line indicated by the arrows II—II in FIG. 1.
Figure 1:
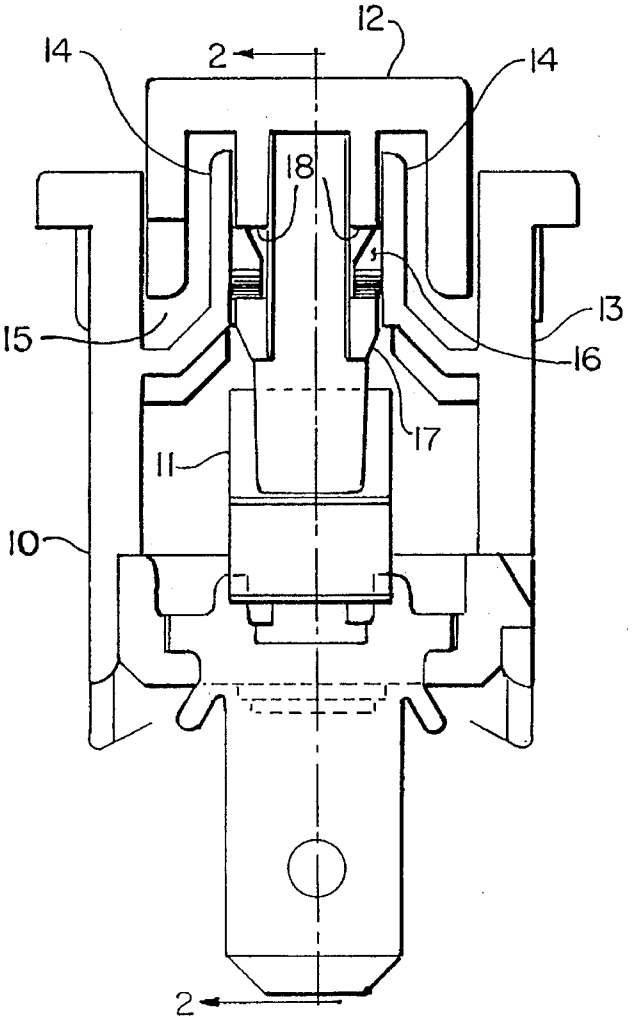
FIG. 1 is a partial cross-sectional view of the switch pursuant to the invention.

The switch in issue includes a four-sided body [10] that contains in a known manner, the electrical components [11] and whose front is provided with a rocker key [12]. Inside, the front of the body [10] includes, positioned concentrically in relation to its perimeter walls [13], second contiguous walls [14] that are parallel to the perimeter walls [13] and that in conjunction with the latter define a continuous channel [15]. This channel [15] involves only a portion of the depth of the body [10], is completely closed at the bottom, i.e., at the side adjoining the inside of the body [10], and is open at the top. The rocker key [12] is located in this channel, and moves back and forth within it.

More specifically, the inner walls [14] that help define this channel [15] are higher than the perimeter walls [13] of the body. The edge of the perimeter walls [13], which are lower, essentially forms a spillway for the discharge of any water that may collect in the channel [15]. On the other hand, the inner walls [14], which are higher, reliably prevent the water from entering the body, even when the channel is full. In fact, in any event the water is discharged over the spillway defined by the perimeter walls [13] without ever reaching the top of the inner walls [14].

Two pins [16] that face each other are provided in the facing surfaces of the two parallel inner walls. The underside of the rocker key [12] has two fins [17] that are inserted between the above-mentioned two facing inner walls and that are provided with holes [18] that are intended to receive the pins [16] so that the pivoting rocker key [12] can be installed in the body of the switch.

What is claimed is:

1. An electrical switch with a horizontally pivoting key, having a body [10] defining a front and back that has a continuous perimeter wall [13] comprised of four sides and, internally, at the front of the body, a continuous inner wall [14] comprised of four sides that are parallel to respective sides of the perimeter wall [13] and that in conjunction with the perimeter wall defines a continuous channel [15] for the collection and discharge of water or condensation, the horizontally pivoting key being partially located within the channel and the sides of the continuous inner wall extend beyond the sides of the continuous perimeter wall [13] of the body of the switch.

2. An electrical switch pursuant to claim 1, wherein the channel [15] is completely closed on a side facing an inside of said body [10] but is open toward the front of the body, and in which a front edge of the perimeter wall [13], which is lower with respect to a top of the inner wall, provides an outlet in the form of a spillway for the discharge of water from said channel, and prevents the level of water in said channel from reaching the top of the higher inner wall [14].

3. An electrical switch pursuant to claim 1, wherein the sides of the inner wall have surfaces and two pins [16] that face each other and are provided in the surfaces of the sides of the inner wall, and in which the rocker key [12] has two fins [17] that are inserted between said sides of the inner wall and have holes therein [18] intended to receive said pins [16] so that the rocker key can be installed in the body of the switch.

4. An electrical switch comprising:

(a) a horizontal pivoting key; and (b) a body, the body having a front portion and an inside, and the body including a continuous perimeter wall comprised of four sides and, internally, at the front portion a continuous inner wall comprised of four sides that are parallel to respective sides of the perimeter wall, and the continuous inner wall in conjunction with the perimeter wall defining a continuous channel adapted to collect and to discharge water or condensation, and the channel having a bottom end and a top end, and the horizontally pivoting key being partially located within the channel and the sides of the continuous inner wall extend beyond the sides of the continuous perimeter wall of the body of the switch.

5. The electrical switch of claim 4, wherein:

(a) the continuous inner wall includes two sides which each define a surface, with the two respective surfaces facing each other;

(b) two pins facing each other provided in the facing surfaces of the two sides; and (c) the pivoting key defines a rocker key having two fins, with the two fins being inserted between the two sides and having apertures therein adapted to receive the pins such that the rocker key can be installed in the body of the switch.

6. The electrical switch of claim 4, wherein the channel is completely closed on the bottom end facing the inside of the body and is open toward the top end, and the perimeter wall has a front edge providing an outlet which will, when water discharges from the channel, provide a spillway and thereby prevent the water in the channel from reaching a level at a op of the higher inner wall.

7. The electrical switch of claim 6, wherein:

(a) the continuous inner wall includes two sides which each define a surface, with the two respective surfaces facing each other;

(b) two pins facing each other provided in the facing surfaces of the two sides; and (c) the pivoting key defines a rocker key having two fins, with the two fins being inserted between the two sides and having apertures therein adapted to receive the pins such that the rocker key can be installed in the body of the switch.

8. An electrical switch comprising:

(a) a horizontally pivoting key; and (b) a body, the body having a front portion and an inside, and the body including a continuous perimeter wall comprised of four sides and, internally, at the front portion, a continuous inner wall comprised of four sides that are parallel to respective sides of the perimeter wall, and the continuous inner wall in conjunction with the perimeter wall defining a continuous channel adapted to collect and to discharge water or condensation, and the channel having a bottom end and a top end, and wherein the sides of the continuous inner wall extend beyond the sides of the continuous wall of the body of the switch;

(c) whereby the horizontally pivoting key is attached to two sides of the continuous inner wall.

9. The electrical switch according to claim 8, wherein:

(a) two pins facing each other are provided in two sides of the continuous inner wall; and (b) the pivoting key defines a rocker key having two fins, with the two fins being inserted between the two sides of the continuous inner wall and having apertures therein adapted to receive the pins such that the rocker key can be installed in the body of the switch.

* * * * *